US009636716B2

(12) United States Patent
Hirata et al.

(10) Patent No.: US 9,636,716 B2
(45) Date of Patent: May 2, 2017

(54) VACUUM CLEANING DEVICE

(71) Applicants: IHI Corporation, Tokyo (JP); IHI Machinery and Furnace Co., Ltd., Tokyo (JP)

(72) Inventors: Atsushi Hirata, Tokyo (JP); Yasuhiro Shigegaki, Tokyo (JP); Tetsuya Hirata, Tokyo (JP); Kazuo Miyoshi, Tokyo (JP); Yoshiyasu Matsuda, Tokyo (JP); Noboru Hiramoto, Tokyo (JP)

(73) Assignees: IHI CORPORATION (JP); IHI MACHINERY AND FURNACE CO., LTD. (JP)

( * ) Notice: Subject to any disclaimer, the term of this patent is extended or adjusted under 35 U.S.C. 154(b) by 353 days.

(21) Appl. No.: 14/457,277

(22) Filed: Aug. 12, 2014

(65) Prior Publication Data

US 2014/0352100 A1 Dec. 4, 2014

Related U.S. Application Data

(63) Continuation of application No. PCT/JP2013/061411, filed on Apr. 17, 2013.

(30) Foreign Application Priority Data

Apr. 25, 2012 (JP) ..... 2012-100312

(51) Int. Cl.
*B08B 5/04* (2006.01)
*B08B 7/04* (2006.01)
(Continued)

(52) U.S. Cl.
CPC ..... *B08B 5/04* (2013.01); *B08B 3/10* (2013.01); *B08B 7/04* (2013.01); *C23G 5/04* (2013.01)

(58) Field of Classification Search
CPC .. A47L 11/34; A47L 11/4088; A47L 11/4083; A47L 11/4044; A47L 11/30
See application file for complete search history.

(56) References Cited

U.S. PATENT DOCUMENTS 5,142,873 A 9/1992 Ramsey ..... 62/11
5,232,476 A 8/1993 Grant
(Continued)

FOREIGN PATENT DOCUMENTS

CN 1134321 A 10/1996
CN 201135976 Y 10/2008
(Continued)

OTHER PUBLICATIONS

International Search Report and Written Opinion mailed Jul. 30, 2013 in corresponding PCT International Application No. PCT/JP2013/061411.
(Continued)

*Primary Examiner* — Robert Scruggs
(74) *Attorney, Agent, or Firm* — Ostrolenk Faber LLP

(57) ABSTRACT

This vacuum cleaning device is provided with: a vapor chamber in which vapor of a hydrocarbon-based cleaning agent is generated; a condensation chamber; a first heat exchanger in which heat exchange between the vapor and a heating medium is carried out; a cleaning chamber in which a workpiece can be cleaned under vacuum by the condensed cleaning agent that has been generated in the condensation chamber; a compressor that adiabatically compresses and further heats the heating medium that was heated by the first heat exchanger; a second heat exchanger that carries out heat exchange between the heating medium heated by the compressor and the hydrocarbon-based cleaning agent in the vapor chamber; and a vacuum unit that further cools the heating medium that has been cooled by the second heat exchanger by forcing vacuum expansion of the heating
(Continued)

medium. The heating medium cycles through the first heat exchanger, the compressor, the second heat exchanger, and the vacuum unit by the heating medium cooled by the vacuum unit being returned to the first heat exchanger.

7 Claims, 4 Drawing Sheets

(51) Int. Cl.
*B08B 3/10* (2006.01)
*C23G 5/04* (2006.01)

(56) References Cited

U.S. PATENT DOCUMENTS

| | | | | |
|---|---|---|---|---|
| 5,548,866 | A * | 8/1996 | Reed | A47L 11/34 15/320 |
| 2005/0160553 | A1* | 7/2005 | Gregory | A47L 7/0009 15/320 |
| 2007/0079470 | A1* | 4/2007 | Rippl | A47L 11/34 15/320 |

FOREIGN PATENT DOCUMENTS

| | | | |
|---|---|---|---|
| CN | 101314158 | A | 12/2008 |
| DE | 10024244 | A1 | 11/2001 |
| JP | 63-248486 | | 10/1988 |
| JP | A-64-018483 | | 1/1989 |
| JP | 03-031113 | | 5/1991 |
| JP | 04-37753 | B2 | 6/1992 |
| JP | 07-166385 | | 6/1995 |
| JP | B-2551777 | | 8/1996 |
| JP | 10-192797 | | 7/1998 |
| JP | 2003-236479 | | 8/2003 |
| JP | 2008-275313 | | 11/2008 |
| JP | 2010-082524 | | 4/2010 |
| JP | 2011-047570 | | 3/2011 |
| JP | 2011-64354 | | 3/2011 |
| TW | 207959 | | 6/1993 |
| TW | 306889 | | 6/1997 |
| TW | 1259202 | | 8/2006 |
| WO | WO 92/08554 | | 5/1992 |
| WO | WO 2011/114085 | A1 | 9/2011 |

OTHER PUBLICATIONS

Chinese Office Action, dated Jun. 11, 2015, issued in corresponding Chinese Patent Application No. 201380021211.7. English translation. Total 14 pages.

Taiwan Office Action, dated Jun. 23, 2015, issued in corresponding Taiwanese Patent Application No. 102113417, English translation of Search Report. Total 7 pages.

Office Action dated Jan. 8, 2015 and Search Report in corresponding Taiwanese Patent Application No. 102113417 with English language translation (11 pages).

European Search Report, dated Dec. 2, 2015, issued in corresponding European Patent Application No. EP13781328.3. Total 8 pages.

* cited by examiner

VACUUM CLEANING DEVICE

This application is a continuation application based on a PCT Patent Application No. PCT/JP2013/061411, filed Apr. 17, 2013, whose priority is claimed on Japanese Patent Application No. 2012-100312, filed Apr. 25, 2012. The contents of both the PCT application and the Japanese Patent Application are incorporated herein by reference.

TECHNICAL FIELD

The present invention relates to a vacuum cleaning device configured to supply vapor of a hydrocarbon-based cleaning agent into a decompressed cleaning chamber and clean a workpiece.

BACKGROUND ART

In the related art, the vacuum cleaning device disclosed in Patent Document 1 for example, is known. In such a vacuum cleaning device, first, a decompression process of decompressing a vapor cleaning and drying chamber into which a workpiece is loaded using a vacuum pump is performed, and then a vapor cleaning process of supplying vapor of a hydrocarbon-based cleaning agent into the vapor cleaning and drying chamber to clean the workpiece is performed. Next, a spraying dipping cleaning process of cleaning, in particular, a gap or the like in the workpiece that is insufficiently cleaned in the vapor cleaning process by spraying the hydrocarbon-based cleaning agent to the workpiece or dipping the workpiece in the hydrocarbon-based cleaning agent stored in a dipping chamber is performed. When the cleaning of the workpiece is completely performed in this way, after the workpiece is conveyed into the vapor cleaning and drying chamber again, a drying process of further decompressing the vapor cleaning and drying chamber and evaporating a cleaning agent stuck to a surface of the workpiece is performed. Then, when the drying process is terminated, the workpiece is unloaded after the vapor cleaning and drying chamber is returned to atmospheric pressure, thus finishing the series of processes.

In such a vacuum cleaning device, the spent hydrocarbon-based cleaning agent (contaminant and the hydrocarbon-based cleaning agent stuck to the workpiece, hereinafter referred to as the spent cleaning agent) is sent to the vapor chamber to be reclaimed. Specifically, the spent cleaning agent sent to the vapor chamber is heated by an electric heater or the like to become vapor consisting substantially of only the hydrocarbon-based cleaning agent (distillation). Then, only the generated vapor of the hydrocarbon-based cleaning agent is used in the vapor cleaning process again, or cooled and condensed by a cooler using cooling water and then used in a spraying dipping cleaning process.

However, in the technology of Patent Document 1, the heat used to generate the vapor of the hydrocarbon-based cleaning agent in a vapor chamber is recovered by the cooler and discarded. In addition, a large amount of cooling water, about 200 L/min, is needed to cool the vapor, and a reservoir, a cooling tower, and so on, are also needed to increase the size of the device.

Accordingly, there is disclosed a technology, in the vapor cleaning device of atmospheric pressure, in which two-step heat exchange using a first heat exchange unit used to cool the spent cleaning agent in the vapor state generated in the vapor cleaning and drying chamber using water (liquid) as a thermal medium and a second heat exchange unit used to indirectly recover heat obtained by the first heat exchange unit is performed, and sensible heat obtained by the water (liquid) is supplied to the vapor chamber (for example, Patent Document 2).

DOCUMENT OF RELATED ART

Patent Documents

[Patent Document 1] Japanese Unexamined Patent Application, First Publication No. H07-166385

[Patent Document 2] Japanese Unexamined Patent Application, Second Publication No. H03-31113

SUMMARY OF INVENTION

Technical Problem

However, in the technology of Patent Document 2, the first heat exchange unit has low recovery efficiency of heat of about 1/10 to 1/100 in comparison with the case of using sensible heat of water to recover heat of the spent cleaning agent or using latent heat of a thermal medium to perform heat exchange through two steps of the second heat exchange unit configured to indirectly recover the heat obtained by the first heat exchange unit. Accordingly, in order to sufficiently recover the heat using the first heat exchange unit, a contact area between the first heat exchange unit and the second heat exchange unit should be increased, and the heat exchanger is being increased in size. Accordingly, when the technology of Patent Document 2 is simply applied to the vacuum cleaning device, a volume occupied by the device itself may be increased.

An object of the present invention is to provide a vacuum cleaning device capable of efficiently recovering heat used in a vapor chamber without increasing the size of the device itself.

Solution to Problem

In order to solve the problems, a first aspect according to a vacuum cleaning device of the present invention includes a vapor chamber configured to generate vapor of a hydrocarbon-based cleaning agent; a condensation chamber connected to the vapor chamber; a first heat exchanger configured to condense the vapor to form the hydrocarbon-based cleaning agent and heat a thermal medium by performing heat exchange of the vapor introduced from the vapor chamber with the thermal medium in the condensation chamber; a cleaning chamber configured to clean a workpiece under decompression by the condensed hydrocarbon-based cleaning agent supplied from the condensation chamber; a compressor configured to insulate, compress and further heat the thermal medium heated by the first heat exchanger; a second heat exchanger configured to evaporate the hydrocarbon-based cleaning agent to generate vapor and cool the thermal medium by performing heat exchange of the thermal medium heated by the compressor with the hydrocarbon-based cleaning agent in the vapor chamber; and a decompression unit configured to decompress, expand and further cool the thermal medium cooled by the second heat exchanger, wherein, as the thermal medium cooled by the decompression unit is sent back to the first heat exchanger, the thermal medium circulates through the first heat exchanger, the compressor, the second heat exchanger, and the decompression unit.

In addition, in the first aspect, the decompression unit may be constituted by an expansion valve.

In addition, in the first aspect, the decompression unit may be constituted by a turbine rotated by the thermal medium cooled by the second heat exchanger, and the compressor may be assisted to be driven by rotational power of the turbine.

In addition, in the first aspect, the vacuum cleaning device may include a third heat exchanger configured to perform heat exchange of a thermal medium flowing between the first heat exchanger and the compressor with a thermal medium flowing between the second heat exchanger and the decompression unit.

In addition, in the first aspect, the hydrocarbon-based cleaning agent may be a class III petroleum cleaning agent.

Effects of Invention

According to the present invention, heat used in the vapor chamber can be efficiently recovered without increasing a size of the device itself.

DESCRIPTION OF EMBODIMENTS

Figure 1:
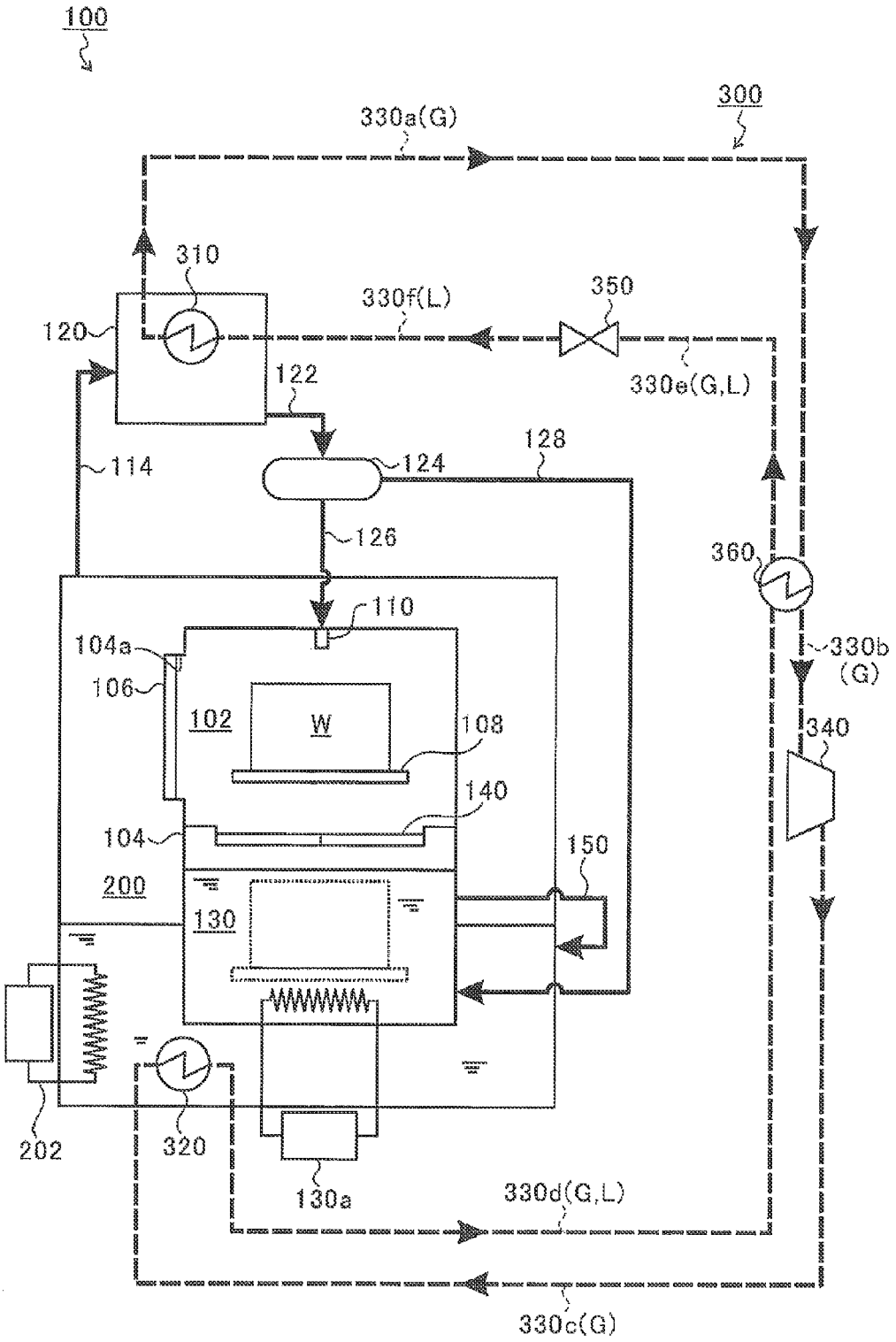
FIG. 1 is a conceptual view showing a vacuum cleaning device according to an embodiment of the present invention.

An example embodiment of the present invention will be described below in detail with reference to the accompanying drawings. Dimensions, materials and specific numerical values described in the embodiment are exemplarily provided for the convenience of understanding of the present invention and are not intended to limit the present invention unless the context clearly indicates otherwise. Further, in the specification and the drawings, elements having substantially the same functions and configurations are designated by the same reference numerals and an overlapping description thereof will be omitted, and elements that are not directly related to the present invention will not be shown.

(Vacuum Cleaning Device 100)

FIG. 1 is a conceptual view showing a vacuum cleaning device 100. As shown in FIG. 1, the vacuum cleaning device 100 includes a vacuum container 104 in which a cleaning chamber 102 is installed. An opening 104*a* is formed in the vacuum container 104, and the opening 104*a* is configured to be opened and closed by an opening/closing door 106. Accordingly, when a workpiece W is cleaned, the opening/closing door 106 is opened to load the workpiece W into the cleaning chamber 102 from the opening 104*a* to be placed on a placing section 108, the opening/closing door 106 is closed to clean the workpiece W, and then the opening/closing door 106 is opened again to unload the workpiece W from the opening 104*a*.

Then, a shower unit 110 is installed at the cleaning chamber 102. The shower unit 110 is connected to a vapor chamber 200 via a vapor supply pipe 114, a condensation chamber 120, a condensed cleaning agent supply pipe 122, a cleaning agent storage section 124, and a condensed cleaning agent supply pipe 126.

The vapor chamber 200 includes a heater 202 and a second heat exchanger 320, and heats a hydrocarbon-based cleaning agent (solvent) to, for example, about 80 to 140° C., preferably about 120° C., to generate vapor of the hydrocarbon-based cleaning agent (hereinafter, simply referred to as "vapor"). The vapor generated in the vapor chamber 200 is introduced into the condensation chamber 120 via the vapor supply pipe 114.

The condensation chamber 120 includes a first heat exchanger 310, and the vapor introduced into the condensation chamber 120 is cooled by the first heat exchanger 310 and condensed into a hydrocarbon-based cleaning agent in a liquid phase (hereinafter, simply referred to as "a condensed cleaning agent"). Then, the condensed cleaning agent is stored in the cleaning agent storage section 124 via the condensed cleaning agent supply pipe 122, and then supplied into the cleaning chamber 102 via the condensed cleaning agent supply pipe 126 and the shower unit 110. A cooling mechanism constituted by the first heat exchanger 310 and a heating mechanism constituted by the second heat exchanger 320 will be described below in detail.

In addition, a dipping chamber 130 disposed below the cleaning chamber 102 is installed in the vacuum container 104. The amount of the hydrocarbon-based cleaning agent (liquid) in which the workpiece W can be completely dipped is stored in the dipping chamber 130, and a heater 130*a* configured to heat the hydrocarbon-based cleaning agent is installed at the dipping chamber 130. In addition, a middle door 140 is installed between the cleaning chamber 102 and the dipping chamber 130, and brings the cleaning chamber 102 and the dipping chamber 130 in communication with each other or blocks the communication.

Further, the hydrocarbon-based cleaning agent stored in the dipping chamber 130 is any one or both of the condensed cleaning agent supplied from the shower unit 110 and the condensed cleaning agent supplied from the cleaning agent storage section 124 via a condensed cleaning agent supply pipe 128. In addition, in the embodiment, an elevation apparatus (not shown) is installed at the placing section 108, and the placing section 108 is configured to be vertically movable. Accordingly, as the elevation apparatus is driven in a state in which the middle door 140 is opened to bring the cleaning chamber 102 and the dipping chamber 130 in communication with each other, as shown by a broken line of FIG. 1, the workpiece W can be moved from the cleaning chamber 102 to the dipping chamber 130 or the workpiece W can be moved from the dipping chamber 130 to the cleaning chamber 102.

Then, the condensed cleaning agent that is supplied from the shower unit 110 and has cleaned the workpiece W or the condensed cleaning agent that has cleaned the workpiece W in the dipping chamber 130 (hereinafter, simply referred to as a spent cleaning agent) is introduced into the vapor chamber 200 again via a spent cleaning agent introduction pipe 150, and heated by the above-mentioned heater 202 or the second heat exchanger 320 to become vapor (reclamation).

Further, the kind of the hydrocarbon-based cleaning agent is not particularly limited but a class III petroleum cleaning agent may be preferably used in view of safety, for example, normal paraffin-based, isoparaffin-based, naphthene-based, and aromatic hydrocarbon-based cleaning agents may be preferable. Specifically, as the class III petroleum cleaning agent, Techclean N20, Cleansol G, Dafney solvent, and so on, which are cleaning solvents, may be preferably used.

In addition, a vacuum pump (not shown) is connected to the cleaning chamber 102 and the vapor chamber 200. The vacuum pump decompresses the inside of the vacuum container 104 and the vapor chamber 200 to, for example, about 6 kPa, through vacuuming (initial vacuum) in a decompression process before cleaning of the workpiece W starts. Further, a pipe (not shown) configured to open the cleaning chamber 102 to the atmosphere is connected to the cleaning chamber 102. An atmosphere opening valve configured to block the connection between the atmosphere and the cleaning chamber 102 is installed at the pipe. The atmosphere opening valve opens the cleaning chamber 102 to the atmosphere to return to atmospheric pressure in the unloading process after the cleaning process and the drying process of the workpiece W are finished.

Next, a vacuum cleaning method of the workpiece W in the vacuum cleaning device 100 will be described with reference to FIGS. 1 and 2.

Figure 2:
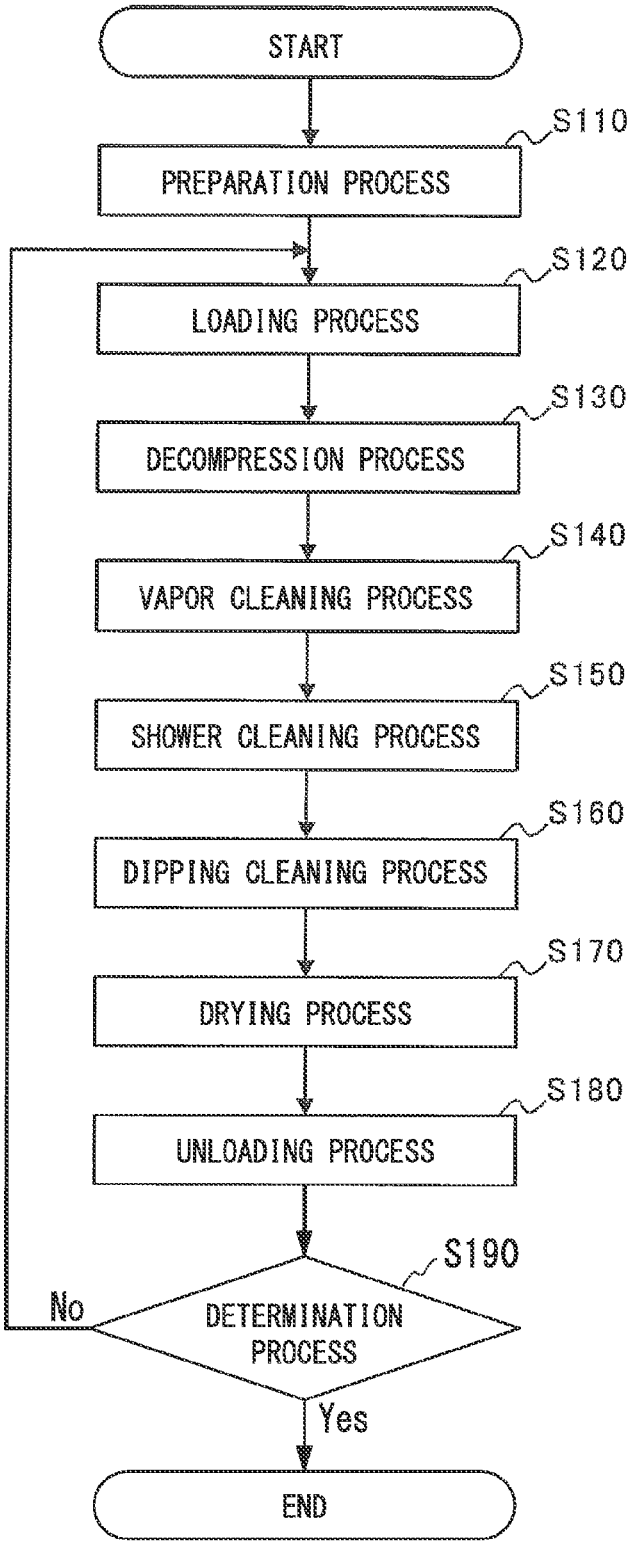
FIG. 2 is a flowchart showing a processing process of the vacuum cleaning device according to the embodiment of the present invention.

FIG. 2 is a flowchart showing a processing process of the vacuum cleaning device 100. To use the vacuum cleaning device 100, first, a preparation process (step S110) is performed once, and then a loading process (step S120), a decompression process (step S130), a vapor cleaning process (step S140), a shower cleaning process (step S150), a dipping cleaning process (step S160), a drying process (step S170) and an unloading process (step S180) are performed on one workpiece W. Then, the processes of step S120 to step S180 are performed on sequentially loaded workpieces W. Hereinafter, the above-mentioned processes will be described with reference to FIG. 1.

(Preparation Process: Step S110)

First, as the vacuum cleaning device 100 is operated, the opening/closing door 106 is closed to block the inside of the vacuum container 104 from the outside. Then, the middle door 140 is opened to bring the dipping chamber 130 in communication with the cleaning chamber 102. Next, the vacuum pump is driven to decompress the cleaning chamber 102 and the dipping chamber 130 to, for example, 10 kPa or less, through vacuuming. In this way, when the cleaning chamber 102 and the dipping chamber 130 are decompressed to a desired pressure, the middle door 140 is closed to block the dipping chamber 130 from the cleaning chamber 102. Then, after the blocking, the atmosphere opening valve is opened to open the cleaning chamber 102 to the atmosphere.

Then, the heater 202 and a heat pump unit 300 (the second heat exchanger 320) (to be described below) are driven to heat the hydrocarbon-based cleaning agent stored in the vapor chamber 200 to generate vapor. Then, the vapor generated in the vapor chamber 200 is introduced into the condensation chamber 120, cooled by the heat pump unit 300 (the first heat exchanger 310), condensed by the condensed cleaning agent, and stored in the cleaning agent storage section 124. Alternatively, the vapor is stored in the dipping chamber 130 via the condensed cleaning agent supply pipe 128. In addition, the heater 130*a* is driven to heat the hydrocarbon-based cleaning agent stored in the dipping chamber 130 to generate vapor. Here, since the middle door 140 is closed, the vapor generated in the dipping chamber 130 is filled in the dipping chamber 130. Accordingly, the preparation process of the vacuum cleaning device 100 is finished, and cleaning of the workpiece W by the vacuum cleaning device 100 becomes possible.

(Loading Process: Step S120)

When the cleaning of the workpiece W is performed by the vacuum cleaning device 100, first, the opening/closing door 106 is opened, and the workpiece W is loaded into the cleaning chamber 102 from the opening 104*a* to be placed on the placing section 108. Then, when the loading of the workpiece W is finished, the opening/closing door 106 is closed to form a closed state of the cleaning chamber 102. Further, a temperature of the workpiece W becomes a normal temperature (about 15 to 40 degrees).

(Decompression Process: Step S130)

Next, the vacuum pump is driven, and the cleaning chamber 102 and the vapor chamber 200 are decompressed to 10 kPa or less through vacuuming.

(Vapor Cleaning Process: Step S140)

Next, the middle door 140 is opened to bring the cleaning chamber 102 and the dipping chamber 130 in communication with each other, and the vapor generated by the dipping chamber 130 is supplied into the cleaning chamber 102. Here, the temperature of the vapor is controlled to 80 to 140° C., and the cleaning chamber 102 is filled with the high temperature vapor.

In this way, when the vapor supplied into the cleaning chamber 102 is stuck to the surface of the workpiece W, since the temperature of the workpiece W is lower than that of the vapor, the vapor is condensed on the surface of the workpiece W, oils and fats stuck to the surface of the workpiece W are dissolved by the condensed hydrocarbon-based cleaning agent and flow down, and the workpiece W is cleaned. The vapor cleaning process is performed until the temperature of the workpiece W reaches 80 to 140° C., which is the temperature of the vapor (a boiling point of the hydrocarbon-based cleaning agent), and the temperature of the workpiece W reaches the temperature of the vapor to finish the vapor cleaning process.

(Shower Cleaning Process: Step S150)

When the vapor cleaning process is finished, the shower unit 110 sprays the condensed cleaning agent stored in the cleaning agent storage section 124 to the workpiece W. In this way, the oils and fats stuck to fine parts of the workpiece W that are not cleaned in the vapor cleaning process are cleaned.

(Dipping Cleaning Process: Step S160)

When the shower cleaning process is finished, the placing section 108 is lowered, and the workpiece W is dipped in the hydrocarbon-based cleaning agent stored in the dipping chamber 130. Here, the workpiece W is repeatedly raised and lowered in a vertical direction a plurality of times by an elevation apparatus (not shown), and the oils and fats or the like stuck to the fine parts of the workpiece W that are not cleaned in the vapor cleaning process or the shower cleaning process are cleaned. When the cleaning of the workpiece W is finished in this way, the placing section 108 is raised to convey the workpiece W into the cleaning chamber 102, and the middle door 140 is closed to block the communication between the cleaning chamber 102 and the dipping chamber 130.

(Drying Process: Step S170)

After the dipping cleaning process of the step S160 is finished, a drying process of drying the hydrocarbon-based cleaning agent stuck to the workpiece W upon the cleaning is performed. The drying process is performed by driving the vacuum pump.

(Unloading Process: Step S180)

As described above, when drying of the cleaning chamber 102 and the workpiece W is finished, the atmosphere opening valve is opened to open the cleaning chamber 102 to the atmosphere, the pressure in the cleaning chamber 102 is returned to atmospheric pressure, the opening/closing door 106 is opened to unload the workpiece W from the opening 104*a*, and all of the processes with respect to the workpiece W are terminated. Alternatively, the processes of step S120 to step S180 may be repeated through a determination process (step S190).

As described above, the vacuum cleaning device 100 according to the embodiment generates vapor by heating the hydrocarbon-based cleaning agent in the vapor chamber 200, and generates the condensed cleaning agent used in the shower unit 110 or the dipping chamber 130 by cooling the vapor in the condensation chamber 120. Here, as the heat pump unit 300 is employed, the vacuum cleaning device 100 remarkably reduces heat loss by using heat recovered by the condensation chamber 120 in the vapor chamber 200. Next, a specific configuration of the heat pump unit 300 will be described.

(Heat Pump Unit 300)

The heat pump unit 300 includes the first heat exchanger 310, the second heat exchanger 320, a thermal medium circulation line 330 (in FIG. 1, shown by 330*a* to 330*f*), a compressor 340, a decompression unit 350, and a third heat exchanger 360. In the heat pump unit 300, as shown by a broken line of FIG. 1, the thermal medium circulates through the thermal medium circulation line 330, and is introduced into the first heat exchanger 310 again via the first heat exchanger 310, the third heat exchanger 360, the compressor 340, the second heat exchanger 320, the third heat exchanger 360, and the decompression unit 350, which are installed at the thermal medium circulation line 330. Further, the kind of the thermal medium is not particularly limited, and fluorocarbon-based thermal media that can use latent heat of the thermal medium in the first heat exchanger 310 may be used.

The first heat exchanger 310 heats the thermal medium while forming the condensed cleaning agent through condensation by cooling the vapor as the thermal medium is heat-exchanged with the vapor introduced from the vapor chamber 200 in the condensation chamber 120. Here, as the thermal medium is heated by the first heat exchanger 310, the thermal medium becomes a gas (in FIG. 1, shown by G). Then, the thermal medium heated by the first heat exchanger 310 is heated by the third heat exchanger 360. The heating mechanism constituted by the third heat exchanger 360 will be described below in detail.

The compressor 340 insulates, compresses and further heats the thermal medium heated by the third heat exchanger 360.

The second heat exchanger 320 cools the thermal medium while generating the vapor by heating the hydrocarbon-based cleaning agent as the thermal medium heated by the compressor 340 is heat-exchanged with the hydrocarbon-based cleaning agent in the liquid phase in the vapor chamber 200. Here, as the thermal medium is cooled by the second heat exchanger 320, the thermal medium becomes a gas-liquid mixed state (in FIG. 1, shown by G and L). Then, the thermal medium cooled by the second heat exchanger 320 is further cooled by the third heat exchanger 360. The cooling mechanism constituted by the third heat exchanger 360 will be described below in detail.

The decompression unit 350 is constituted by an expansion valve, which is a valve configured to generate pressure drop of a fluid, and further cools the thermal medium cooled by the second heat exchanger 320 through decompression and expansion. Here, as the thermal medium is cooled by the decompression unit 350, the thermal medium becomes a liquid (in FIG. 1, shown by L). Then, the thermal medium cooled in the decompression unit 350 is introduced into the first heat exchanger 310 again through the thermal medium circulation line 330*f*.

In the atmospheric pressure vapor cleaning device of the related art, since the cleaning agent should become vapor under atmospheric pressure, a halogen-based cleaning agent (trichloroethane or trichloroethylene) having a boiling point of about 30° C. to 80° C. (atmospheric pressure) is used as the cleaning agent. In such a halogen-based cleaning agent, since chlorine, which is one of the components, is decomposed when heated, corrosiveness is increased, and the heat exchange unit may be immediately corroded when the vapor comes in direct contact with the heat exchange unit. Here, in the related art, two-step heat exchange of the first heat exchange unit in contact with the vapor and the second heat exchange unit used to indirectly recover the heat obtained by the first heat exchange unit is performed such that exchange or maintenance is facilitated. For this reason, a device configuration of the heat exchange unit is complicated, and heat exchange efficiency is decreased in comparison with the case in which the heat exchange is performed in one step.

However, since the vacuum cleaning device 100 according to the embodiment can decompress the cleaning chamber 102, the cleaning agent having a boiling point of about 80 to 140° C. (6 kPa) and no corrosiveness may be used. Accordingly, the first heat exchanger 310 configured to recover the heat in the condensation chamber 120 in direct contact with the vapor can come in communication with the second heat exchanger 320 used in the vapor chamber 200 through the same thermal medium circulation line 330. That is, the heat (latent heat) recovered by cooling the vapor using the first heat exchanger 310 in the condensation chamber 120 can be directly used by the second heat exchanger 320 in the vapor chamber 200, and condensation of the vapor and generation of the vapor can be efficiently performed while suppressing heat loss to a minimum level. Accordingly, a thermal dose of the heater 202 in the vapor chamber 200 can be suppressed.

In addition, as described above, in the atmospheric pressure vapor cleaning device, while the heat is recovered from the vapor having the boiling point of about 30° C. to 80° C., the vacuum cleaning device 100 according to the embodiment can recover the heat from the high temperature vapor having the boiling point of about 80° C. to 140° C. For this reason, the first heat exchanger 310 can recover high heat capacity in comparison with the atmospheric pressure vapor cleaning device.

Further, as described above, in the atmospheric pressure vapor cleaning device, the heat of the spent cleaning agent is recovered using the sensible heat of the water, or the recovered heat is provided to the second heat exchanger. However, the vacuum cleaning device 100 can recover the heat of the cleaning agent using the latent heat of the thermal medium in the first heat exchanger 310 as the fluorocarbon-based material is used as the thermal medium. Accordingly, the first heat exchanger 310 and the second heat exchanger 320 can be reduced in size, and the volume occupied by the vacuum cleaning device 100 itself can be reduced.

The third heat exchanger 360 performs the heat exchange with the thermal medium passing through the thermal medium circulation lines 330*a* and 330*b* (between the first heat exchanger 310 and the compressor 340) and the thermal medium passing through the thermal medium circulation lines 330*d* and 330*e* (between the second heat exchanger 320 and the decompression unit 350). The thermal medium heated by the first heat exchanger 310 and passing through the thermal medium circulation line 330*a* may become a gas-liquid mixed fluid that is not completely vaporized. In this case, when the liquid thermal medium is introduced into the compressor 340, malfunction may occur in the compressor 340.

Here, according to provision of the third heat exchanger 360, as the thermal medium flowing through the thermal medium circulation line 330*a* is heated to a higher temperature than a saturation temperature, the thermal medium introduced into the compressor 340 (the thermal medium flowing through the thermal medium circulation line 330*b*) can be securely changed into a gas only. Accordingly, occurrence of the malfunction in the compressor 340 can be avoided.

Example 1

In a state in which the third heat exchanger 360 is not provided, in the case in which the vapor chamber 200 generates the vapor at 120° C. (Case 1) and the case in which the vapor chamber 200 generates the vapor at 110° C. (Case 2), a temperature of the thermal medium, energy consumption (kW) of the compressor 340, a thermal dose (kW) of the vapor chamber 200 by the second heat exchanger 320 were investigated.

In the vacuum cleaning device of the related art having no heat pump unit, when the vapor chamber generates the vapor at 120° C., the heater requires a capacity of 35 kW (normally, 36 kW upon initial operation).

TABLE 1

| | Case 1 | Case 2 |
|---|---|---|
| Vapor (° C.) | 120 | 110 |
| 330f (° C.) | 92 | 92 |
| 330a (° C.) | 95 | 95 |
| 330c (° C.) | 132 | 122 |
| 330d (° C.) | 128 | 118 |
| Compressor capacity (kW) | 6.5 | 4.2 |
| Vapor chamber thermal dose (kW) | 36.5 | 34.2 |

As described in Table 1, it will be appreciated that, in Case 1, the thermal medium was heated to 92° C. to 95° C. in the first heat exchanger 310, heated to 95° C. to 132° C. by the compressor 340 and cooled to 132° C. to 128° C. in the second heat exchanger 320. In addition, the energy consumption of the compressor 340 was 6.5 kW, and the thermal dose of the vapor chamber 200 by the second heat exchanger 320 was 36.5 kW. Accordingly, it will be appreciated that the same thermal dose as the vacuum cleaning device having no heat pump unit of the related art can be obtained in the vapor chamber 200 with only 6.5 kW used in the compressor 340. That is, when the vapor at 120° C. is generated in the vapor chamber 200, while the thermal dose was 35 kW in the vacuum cleaning device of the related art, the thermal dose of the vacuum cleaning device 100 according to the embodiment was only 6.5 kW. That is, it will be appreciated that energy consumption can be reduced to about 80%.

In addition, as described in Table 1, it will be appreciated that, in Case 2, the thermal medium was heated to 92° C. to 95° C. in the first heat exchanger 310, heated to 95° C. to 122° C. by the compressor 340 and cooled to 122° C. to 118° C. in the second heat exchanger 320. In addition, the energy consumption of the compressor 340 was 4.2 kW, and the thermal dose of the vapor chamber 200 by the second heat exchanger 320 was 34.2 kW. Even in Case 2, it will be appreciated that the same thermal dose as the vacuum cleaning device having no heat pump unit of the related art can be obtained in the vapor chamber 200 with only 4.2 kW used in the compressor 340.

Example 2

In a state in which the third heat exchanger 360 is provided, in the case in which the vapor chamber 200 generates the vapor at 120° C. (Case 3) and the case in which the vapor at 110° C. is generated (Case 4), a temperature of the thermal medium, energy consumption (kW) of the compressor 340 and a thermal dose (kW) of the vapor chamber 200 by the second heat exchanger 320 were investigated.

TABLE 2

| | Case 3 | Case 4 |
|---|---|---|
| Vapor (° C.) | 120 | 110 |
| 330f (° C.) | 92 | 92 |
| 330a (° C.) | 95 | 95 |
| 330b (° C.) | 103 | 101 |
| 330c (° C.) | 139 | 127 |
| 330d (° C.) | 128 | 118 |
| 330e (° C.) | 123 | 114 |
| Compressor capacity (kW) | 6.2 | 4.1 |
| Vapor chamber thermal dose (kW) | 36.2 | 34.1 |

As described in Table 2, it will be appreciated that, in Case 3, the thermal medium is heated to 92° C. to 95° C. in the first heat exchanger 310, heated to 95° C. to 103° C. by the third heat exchanger 360, heated to 103° C. to 139° C. by the compressor 340, cooled to 139° C. to 128° C. in the second heat exchanger 320 and cooled to 128° C. to 123° C. by the third heat exchanger 360. In addition, the energy consumption of the compressor 340 is 6.2 kW, and the thermal dose of the vapor chamber 200 by the second heat exchanger 320 is 36.2 kW.

In addition, as shown in FIG. 2, it will be appreciated that, in Case 4, the thermal medium is heated to 92° C. to 95° C. in the first heat exchanger 310, heated to 95° C. to 101° C. by the third heat exchanger 360, heated to 101° C. to 127° C. by the compressor 340, cooled to 127° C. to 118° C. in the second heat exchanger 320 and cooled to 118° C. to 114° C. by the third heat exchanger 360. In addition, the energy consumption of the compressor 340 is 4.1 kW, and the thermal dose of the vapor chamber 200 by the second heat exchanger 320 is 34.1 kW.

Accordingly, it will be appreciated that, as the third heat exchanger 360 is provided, the temperature of the thermal medium flowing through the thermal medium circulation line 330*b* can reach a saturation temperature or more (in Case 3, the degree of superheat of 8° C., and in Case 4, the degree of superheat of 6° C.), and the thermal medium can be securely evaporated.

(Variant)

Figure 3:
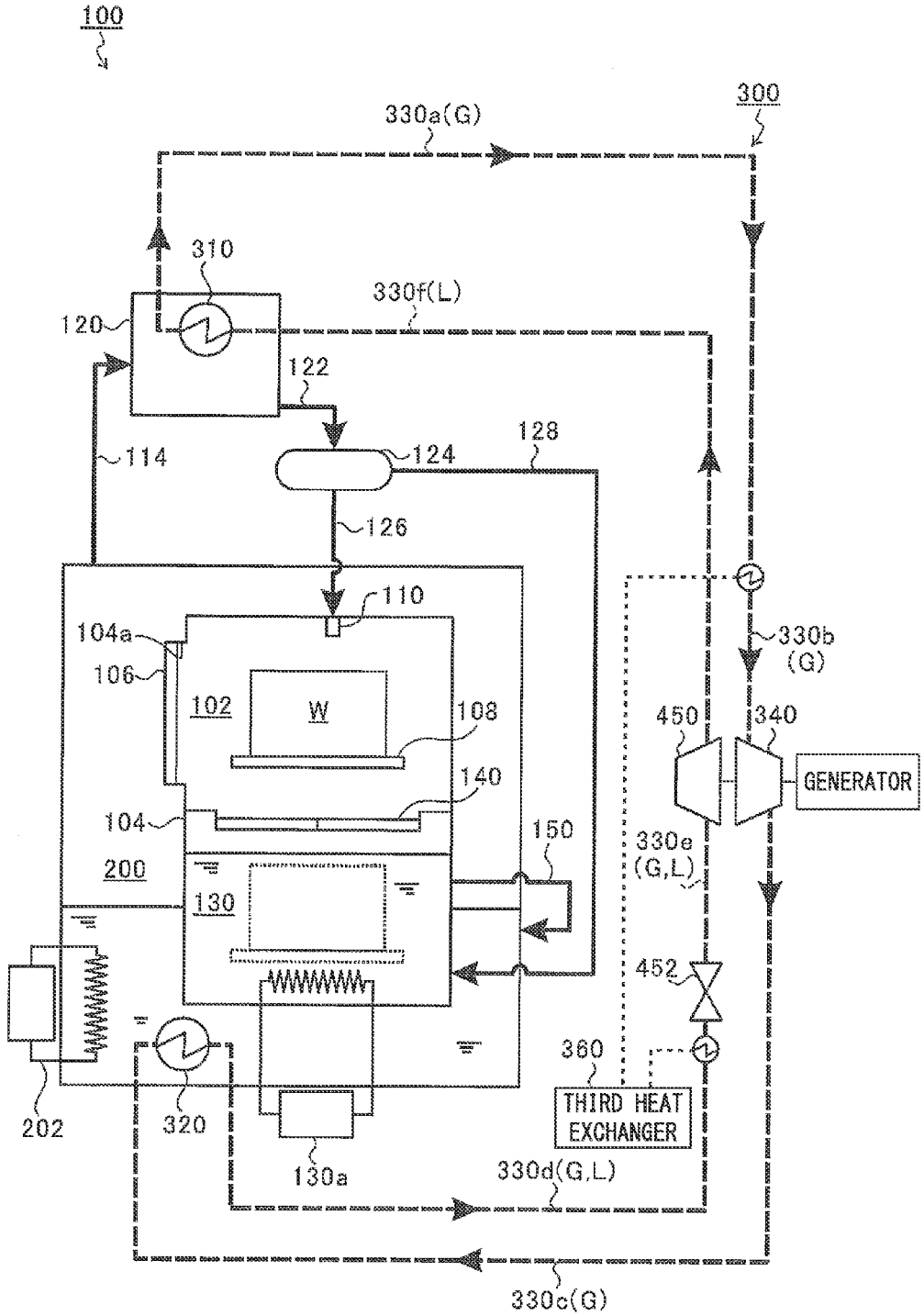
FIG. 3 is a conceptual view showing a vacuum cleaning device of a variant of the present invention.

In the above-mentioned embodiment, while the example in which the decompression unit 350 is constituted by an expansion valve has been exemplarily described, other configurations may be employed as long as the thermal medium can be cooled. FIG. 3 is a conceptual view showing the vacuum cleaning device 100 of the variant. In the vacuum cleaning device 100 of the variant, since the cleaning chamber 102, the vacuum container 104, the opening 104*a*, the opening/closing door 106, the placing section 108, the shower unit 110, the vapor supply pipe 114, the condensation chamber 120, the condensed cleaning agent supply pipes 122, 126 and 128, the cleaning agent storage section 124, the dipping chamber 130, the heater 130*a*, 202, the vapor chamber 200, the heat pump unit 300, the first heat exchanger 310, the second heat exchanger 320, the thermal medium circulation line 330, the compressor 340, and the third heat exchanger 360 have substantially the same functions as in the vacuum cleaning device 100 of the above-mentioned embodiment, the same members are designated by the same reference numerals and overlapping descriptions thereof will be omitted here. Here, a decompression unit 450 having a different function will be described in detail.

As shown in FIG. 3, in the vacuum cleaning device 100 of the variant, the decompression unit 450 is constituted by a turbine rotated by the thermal medium cooled through the second heat exchanger 320, and the compressor 340 is driven by rotational power of the turbine.

As the decompression unit 450 is constituted by the turbine, some of the power for driving the compressor 340 can be recovered using a flow of the thermal medium. Accordingly, in comparison with the case in which the decompression unit 450 is constituted by the expansion valve, energy consumption can be further reduced. Further, in this case, a pressure regulation valve 452 may be installed upstream from the turbine.

Hereinabove, while example embodiments of the present invention have been described with reference to the accompanying drawings, the present invention is not limited to these embodiments. It will be apparent to those skilled in the art that various changes or modifications may be made without departing from the spirit of the claims and may also fall into the technical spirit of the present invention.

For example, even when the heater 202 is not constituted of the first heat exchanger 310 and the second heat exchanger 320, the heater 202 may be used upon only the initial operation as long as the vapor at the target temperature (80° C. to 140° C., for example, 120° C.) in the vapor chamber 200 can be generated.

In addition, although in the above-mentioned embodiment, the configuration in which generation of the vapor by the second heat exchanger 320 in the vapor chamber 200 and generation of the condensed cleaning agent by the first heat exchanger 310 in the condensation chamber 120 are performed through only the preparation process (step S110) has been described, the generation may be performed in step S120 to step S180.

Figure 4:
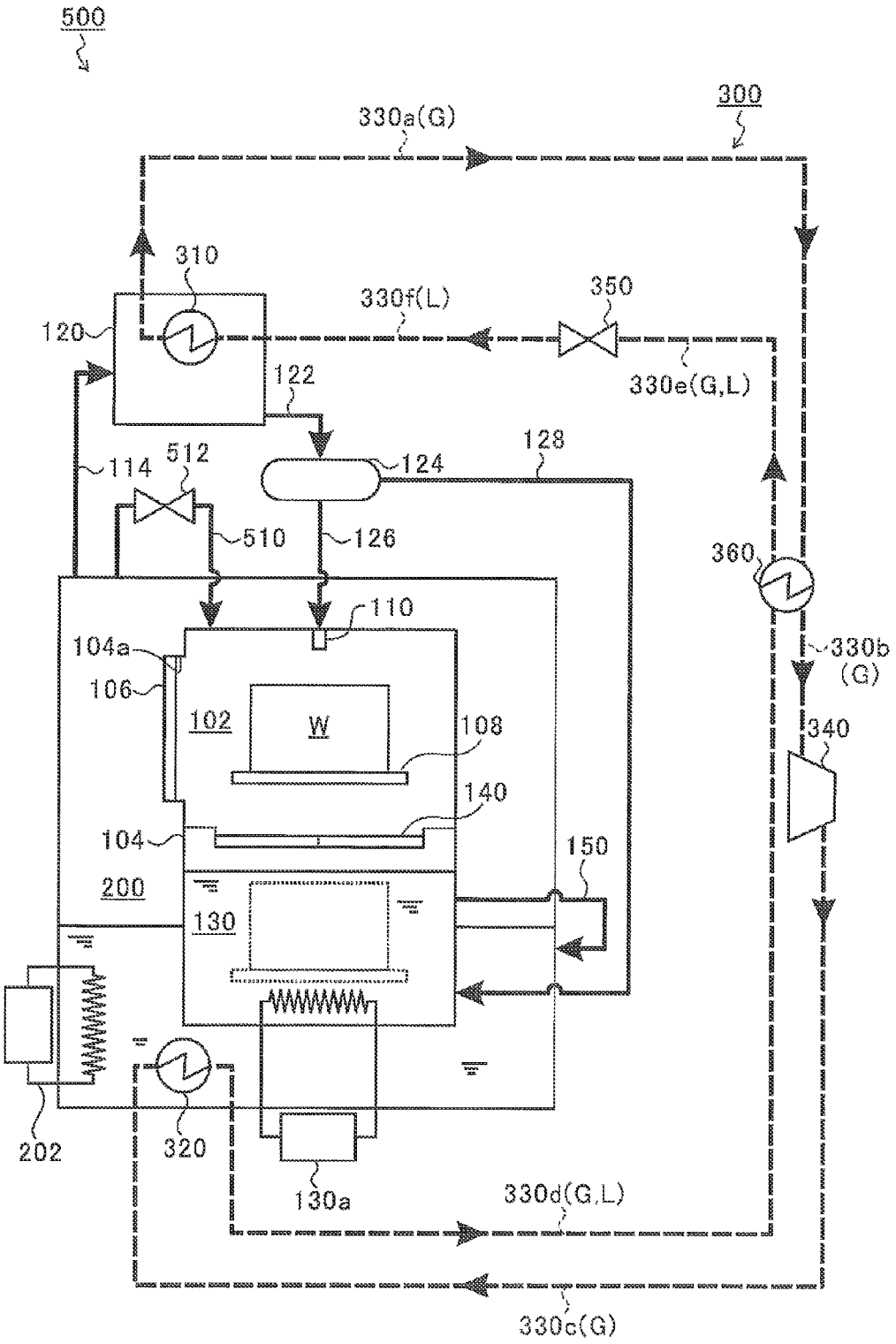
FIG. 4 is a conceptual view showing a vacuum cleaning device of a variant of the present invention.

Further, in the above-mentioned embodiment, when the vapor cleaning is performed, while the vapor generated by the dipping chamber 130 is used, for example, as shown in FIG. 4, a vacuum cleaning device 500 includes a pipe 510 configured to bring the vapor chamber 200 in communication with the cleaning chamber 102, and a valve 512 installed at the pipe 510, and the vapor generated by the vapor chamber 200 may be used. In addition, in this case, the dipping chamber 130 is not a necessary component, and the dipping chamber 130 may not be provided.

Further, the processes of the vacuum cleaning method of the specification need not be processed in time series according to the sequence described in the flowchart, but may be performed in parallel or may include processing by a subroutine.

INDUSTRIAL APPLICABILITY

The present invention may be used in the vacuum cleaning device configured to supply vapor of the hydrocarbon-based cleaning agent into the decompressed cleaning chamber and clean a workpiece.

DESCRIPTION OF REFERENCE SIGNS

100, 500 . . . vacuum cleaning device
102 . . . cleaning chamber
120 . . . condensation chamber
200 . . . vapor chamber
310 . . . first heat exchanger
320 . . . second heat exchanger
340 . . . compressor
350, 450 . . . decompression unit
360 . . . third heat exchanger

The invention claimed is:

1. A vacuum cleaning device comprising:

a vapor chamber configured to generate vapor of a hydrocarbon-based cleaning agent;

a condensation chamber connected to the vapor chamber;

a first heat exchanger configured to condense the vapor to form the hydrocarbon-based cleaning agent and heat a thermal medium by performing heat exchange of the vapor introduced from the vapor chamber with the thermal medium in the condensation chamber;

a cleaning chamber configured to clean a workpiece under decompression by the condensed hydrocarbon-based cleaning agent supplied from the condensation chamber;

a compressor configured to insulate, compress and further heat the thermal medium heated by the first heat exchanger;

a second heat exchanger configured to evaporate the hydrocarbon-based cleaning agent to generate vapor and cool the thermal medium by performing heat exchange of the thermal medium heated by the compressor with the hydrocarbon-based cleaning agent in the vapor chamber;

a decompression unit configured to decompress, expand and further cool the thermal medium cooled by the second heat exchanger; and a third heat exchanger configured to perform heat exchange of a thermal medium flowing between the first heat exchanger and the compressor with a thermal medium flowing between the second heat exchanger and the decompression unit so that the thermal medium heated by the first heat exchanger is further heated by the third heat exchanger and the thermal medium cooled by the second heat exchanger is further cooled by the third heat exchanger, wherein, as the thermal medium cooled by the decompression unit is sent back to the first heat exchanger, the thermal medium circulates through the first heat exchanger, the compressor, the second heat exchanger, and the decompression unit.

2. The vacuum cleaning device according to claim 1, wherein the decompression unit is constituted by an expansion valve.

3. The vacuum cleaning device according to claim 2, wherein the hydrocarbon-based cleaning agent is a class III petroleum cleaning agent.

4. The vacuum cleaning device according to claim 1, wherein the decompression unit is constituted by a turbine rotated by the thermal medium cooled by the second heat exchanger, and the compressor is assisted to be driven by rotational power of the turbine.

5. The vacuum cleaning device according to claim 4, wherein the hydrocarbon-based cleaning agent is a class III petroleum cleaning agent.

6. The vacuum cleaning device according to claim 1, wherein the hydrocarbon-based cleaning agent is a class III petroleum cleaning agent.

7. The vacuum cleaning device according to claim 1, wherein the first heat exchanger is connected to the third heat exchanger through a first line, the third heat exchanger is connected to the compressor through a second line, the compressor is connected to the second heat exchanger through a third line, the second heat exchanger is connected to the third heat exchanger through a fourth line, the third heat exchanger is connected to the decompression unit through a fifth line, and the decompression unit is connected to the first heat exchanger through a sixth line.

* * * * *